US005286923A

United States Patent [19]

Prudhon et al.

[11] Patent Number: 5,286,923

[45] Date of Patent: Feb. 15, 1994

[54] ELECTRIC CABLE HAVING HIGH PROPAGATION VELOCITY

[75] Inventors: Daniel Prudhon, Pierreclos; Victor Da Silva; Pierre Frieden, both of Fumay, all of France

[73] Assignee: Filotex, Draveil, France

[21] Appl. No.: 791,234

[22] Filed: Nov. 13, 1991

[30] Foreign Application Priority Data

Nov. 14, 1990 [FR] France ..... 90-14171

[51] Int. Cl.[5] ..... H01B 11/00

[52] U.S. Cl. ..... 174/113 R; 174/28; 174/29; 174/113 AS; 174/107

[58] Field of Search ..... 174/113 R, 116, 107, 174/113 AS, 28, 29

[56] References Cited

U.S. PATENT DOCUMENTS

| | | | |
|---|---|---|---|
| 2,109,334 | 2/1938 | Kaden et al. | 174/116 X |
| 2,118,907 | 5/1938 | Unterbusch et al. | 174/116 X |
| 2,348,752 | 6/1944 | Quayle . | |
| 2,614,172 | 10/1952 | Greenfield et al. | 174/29 |
| 3,764,725 | 10/1973 | Kafka | 174/29 X |
| 4,541,686 | 9/1985 | Barfuss et al. | 174/107 |
| 4,767,890 | 8/1988 | Magnan | 174/28 |

FOREIGN PATENT DOCUMENTS

| | | | |
|---|---|---|---|
| 599312 | 11/1930 | Fed. Rep. of Germany . | |
| 810882 | 4/1937 | France . | |
| 815143 | 7/1937 | France | 174/29 |
| 570349 | 7/1945 | United Kingdom | 174/28 |

*Primary Examiner*—Morris H. Nimmo

*Attorney, Agent, or Firm*—Sughrue, Mion, Zinn, Macpeak & Seas

[57] ABSTRACT

One embodiment comprises:

two bare parallel conductors made of bronze;

two insulating rods that are substantially helically wound with non-touching turns around the conductors respectively so that the rods interfit and maintain a predetermined distance between the two conductors; and an insulating protective sheath.

The helical pitch of the rods is much greater than the cross-section of the rods so the volume between the two conductors is mostly full of air, thereby obtaining reduced permittivity and thus increased propagation velocity. The invention is applicable to data transmission cables for computer machines.

4 Claims, 3 Drawing Sheets

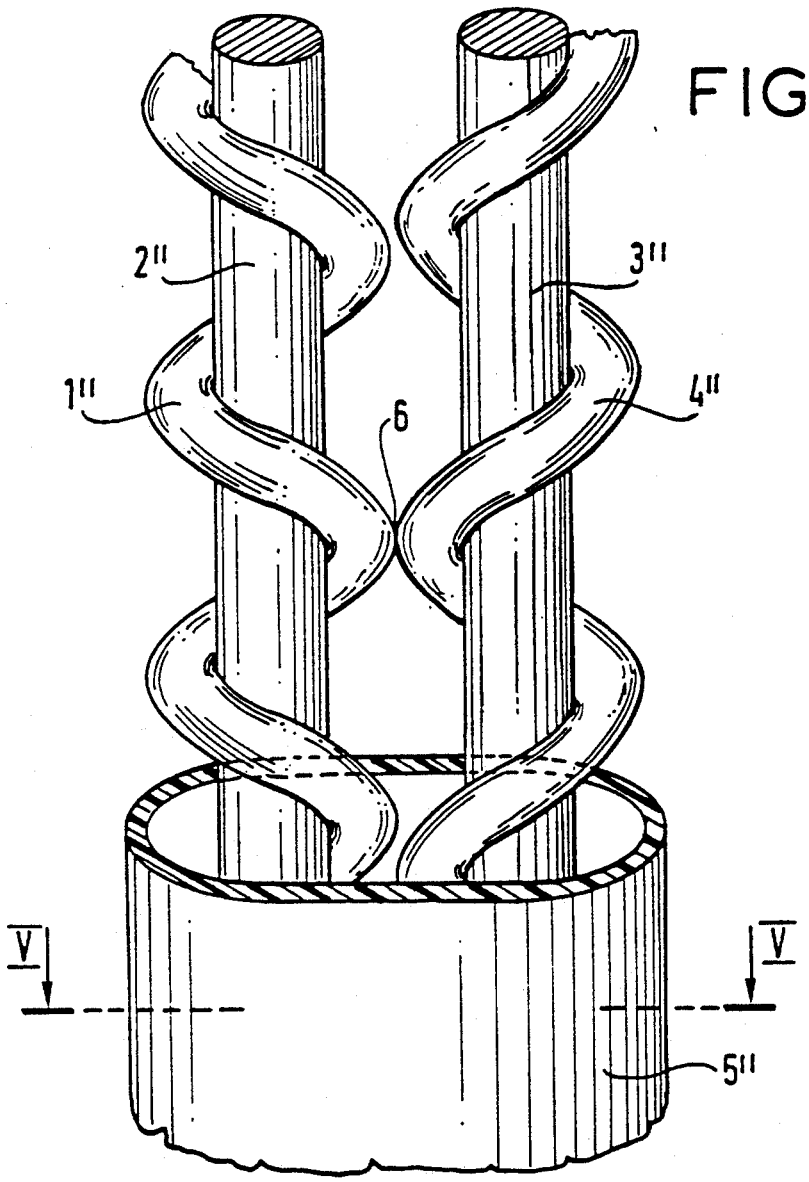
FIG. 4
FIG. 5
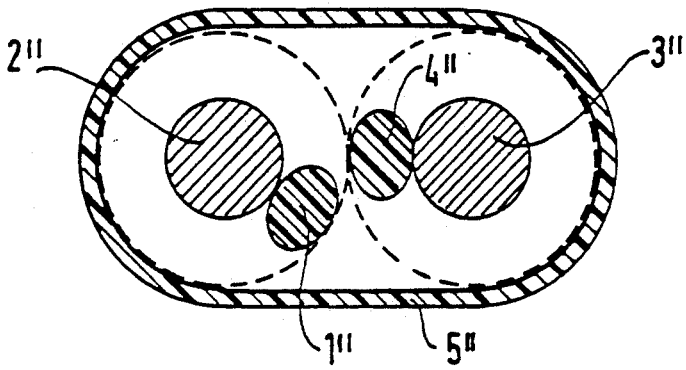

ELECTRIC CABLE HAVING HIGH PROPAGATION VELOCITY

The invention relates to an electric cable having high propagation velocity, such as a cable used for transmitting data from one computer machine to another.

BACKGROUND OF THE INVENTION

A known way of making a cable with high propagation velocity is to reduce the capacitance per unit length that exists between two conductors of the cable, by increasing the distance between the conductors and the distance between the conductors and a screen, and also by reducing the mean value of the permittivity of the dielectrics situated between the two conductors along the cable.

A known way of reducing the mean value of the permittivity of the dielectric between the two conductors of a cable consists in using an expanded plastic. For example, the permittivity of polyethylene is 2.28 when solid, and it is reduced to 1.6 or 1.5 when expanded. However, expanded dielectric materials suffer from the drawback of low mechanical strength which leads to the conductors moving relative to each other when the cable is subjected to bending or twisting. Such displacement gives rise to a local degradation in the electrical characteristics of the cable.

For example, European patent application No. 0 296 692 describes a cable for data transmission comprising:

an insulating core that is cylindrical in shape and that has four spiral-wound uniformly distributed longitudinal grooves formed therein:

four bare conductors placed in the grooves;

a first insulating layer surrounding the set of conductors and the core;

a metallic screen surrounding the insulating layer; and a peripheral second insulating layer providing mechanical protection for the cable as a whole.

That cable is bulky since the diameter of the insulating core is much greater than the diameter of each of the four conductors. It maintains a predetermined distance between the conductors so as to reduce the capacitance per unit length between conductors. The core and the first insulating layer may be made of expanded polytetrafluoroethylene.

The object of the invention is to propose a cable having high propagation velocity without the drawbacks of known types of cable.

SUMMARY OF THE INVENTION

The present invention provides an electric cable having high propagation velocity, the cable comprising a plurality of conductors and means for maintaining a predetermined distance between said conductors;

said means comprising an insulating rod that is helically wound with non-touching turns around at least one of the conductors, with the longitudinal axis of the helix coinciding with that of said conductor, and with each turn surrounding said conductor;

wherein two insulating rods surrounding two adjacent conductors turn in the same direction and have the same constant pitch, the rods interfitting so that the rod surrounding one of the conductors also bears against the other conductor.

The invention also provides a cable wherein two insulating rods surrounding two adjacent conductors turn in opposite directions and are at different pitches that are not multiples of each other, thereby preventing them from interfitting.

BRIEF DESCRIPTION OF THE DRAWINGS

Embodiments of the invention are described by way of example with reference to the accompanying drawings, in which:

FIG. 4 shows a third embodiment of the cable of the invention;

FIG. 5 is a section through the third embodiment;

DETAILED DESCRIPTION

Figure 1:
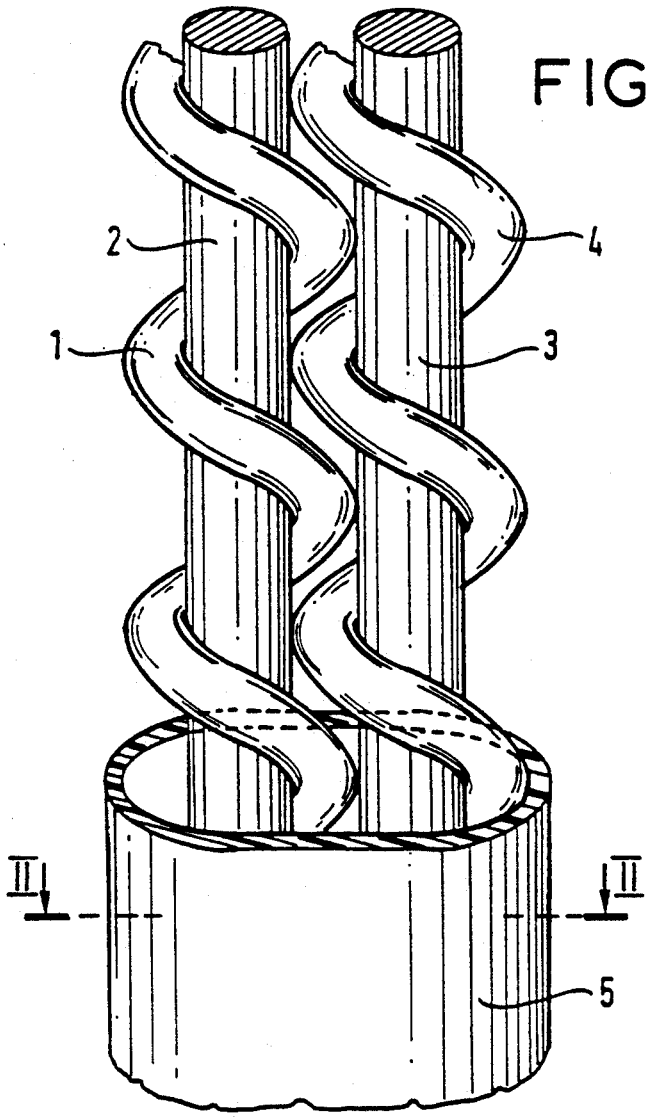
FIG. 1 shows a first embodiment of a cable of the invention.

As shown in FIG. 1, the first embodiment comprises:

Two parallel bare conductors 2 and 3 made of copper or other conducting alloy, which are cylindrical in shape and which have the same diameter;

two rods 1 and 4 of extruded polyethylene, each being helical in shape with non-touching turns, and both wound in the same direction; and a protective insulating sheath 5 of extruded polyethylene covering the cable assembly and being of constant thickness.

The turns of the rod 1 and of the rod 4 surround the conductors 2 and 3 respectively. Each of the rods 1 and 4 is made from a circular section right cylindrical rod which are wound respectively around the conductors 2 and 3. Each rod 1 or 4 thus surrounds one of the conductors with its turns. Both rods 1 and 4 are wound at the same pitch which is constant and much greater than the diameter of the cross-section of each rod such that the volume of the empty space between the turns is much greater than the volume taken up by the turns. Thereafter, the conductors 2 and 3 clamped within the rods 1 and 4 are moved towards each other so that the turns of the rods interfit such that the rod 1 that surrounds the conductor 2 also bearing against the conductor 3. Similarly, the rod 4 that surrounds the conductor 3 also bears against the conductor 2.

Figure 2:
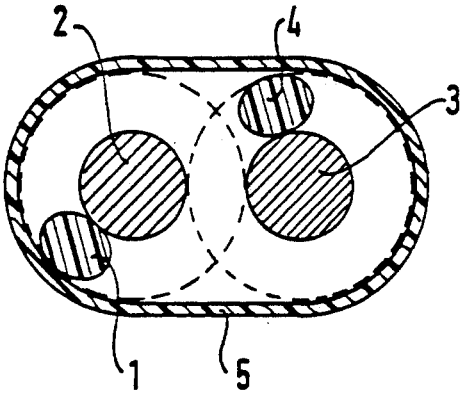
FIG. 2 is a section through this first embodiment.

FIG. 2 is a section through this embodiment on section line II—II. This section shows that the two conductors 2 and 3 are held a predetermined distance apart by the diameter of the cross-section of the rod 1 and of the rod 4. The geometrical envelopes of these helices are shown in dashed lines. The distance between the axes of the conductors 2 and 3 is substantially equal to the sum of the diameter of one conductor and the diameter of the section of each of the rods 1 and 4.

The rod diameter can be selected to hold the conductors far enough apart to reduce capacitance per unit length. However, and above all, this type of cable serves to reduce capacitance per unit length by reducing mean permittivity. The turns of the rods 1 and 4 occupy only a small fraction of the volume situated between the two conductors 2 and 3, with the remainder of the volume being full of air since the insulating material constituting the sheath 5 does not penetrate into the gaps left between the turns. Consequently, the mean permittivity of this volume is less than the permittivity of the polyethylene from which the rods are made.

In an example where the diameter of the conductors is 0.65 mm, the diameter of the rods is 0.9 mm, the pitch is 13.2 mm, and the peripheral layer 5 has a nominal thickness of 3 mm, then the resulting mean permittivity is 1.2, while that of solid polyethylene is 2.28. The characteristic impedance at frequencies greater than 1 MHz is 150 ohms. Conversely, a cable of the invention may occupy less space than a conventional type of cable for equal velocity, attenuation, and impedance.

The above embodiment may be provided with a conventional type of electrical screen, and it may be twisted like a conventional pair.

Variants may consist in replacing the extruded polyethylene sheath 5 with a helically wound insulating tape. The effects of the humidity in the air contained in the cavities between the turns of the rods 1 and 4 can be avoided by depositing a small quantity of powder in these cavities that expands on absorbing humidity, and which is conventionally used for protecting the insides of coaxial cables having a helically wound solid dielectric from the effects of humidity.

Figure 3:
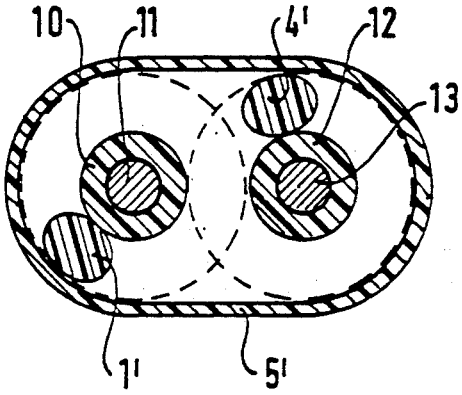
FIG. 3 is a section through a second embodiment constituting a variant of the first.

FIG. 3 is a cross-section through a second embodiment of a cable of the invention, comprising:

two conductors 11 and 13 which are protected from humidity by respective insulating layers 10 and 12 made of extruded polyethylene and that are thin relative to the diameter of the cross-section of a rod;

two rods 1' and 4' analogous to the rods 1 and 4 described above but wound around the layers 10 and 12 respectively instead of coming directly into contact with the conductors 11 and 13; and an insulating sheath 5', analogous to the sheath 5 and surrounding the cable as a whole.

Both of the embodiments described above contain one pair of conductors only, however the scope of the invention is not limited to cables of that type. To make a cable having four conductors, the person skilled in the art is quite capable of interfitting four conductors each provided with its own helically wound rod, and with the axes of the four conductors lying preferably at the vertices of a square. It is also possible to make a multiconductor cable by disposing conductors each provided with its own helically wound rod in such a manner that the axes of the conductors lie in a single plane.

FIG. 4 shows a third embodiment of the cable of the invention, comprising:

two bare parallel conductors 2'' and 3'';

two rods 1'' and 4'' each in the form of a helical winding with non-touching turns; and a protective insulating sheath 5'' of constant thickness covering the cable as a whole.

The component parts of this cable are analogous to the parts of the cable described with reference to FIG. 1, except in that the two rods now turn in opposite directions and are of different pitch. However, the different pitches are not multiples of each other, thereby preventing the two rods from interfitting with each other. In the example shown in FIG. 4, one turn of the rod 1'' and one turn of the rod 4'' are in contact at the point 6, whereas the adjacent turns do not make contact because of the difference in pitch. The turns that do not make contact are sufficiently numerous to hold the two rods apart, thus holding the two conductors apart.

FIG. 5 is a section view through this third embodiment on line V—V. The rods 1'' and 4'' are both circular in right cross-section so the width of the cap between the two conductors 2'' and 3'' is substantially equal to twice the diameter of said right cross-section. If the capacitance per unit length between the two conductors in the third embodiment is compared with the capacitance per unit length between the conductors in the first embodiment, then the capacitance is divided by two for conductors that are identical and for rods having a right cross-section of identical diameter.

Figure 6:
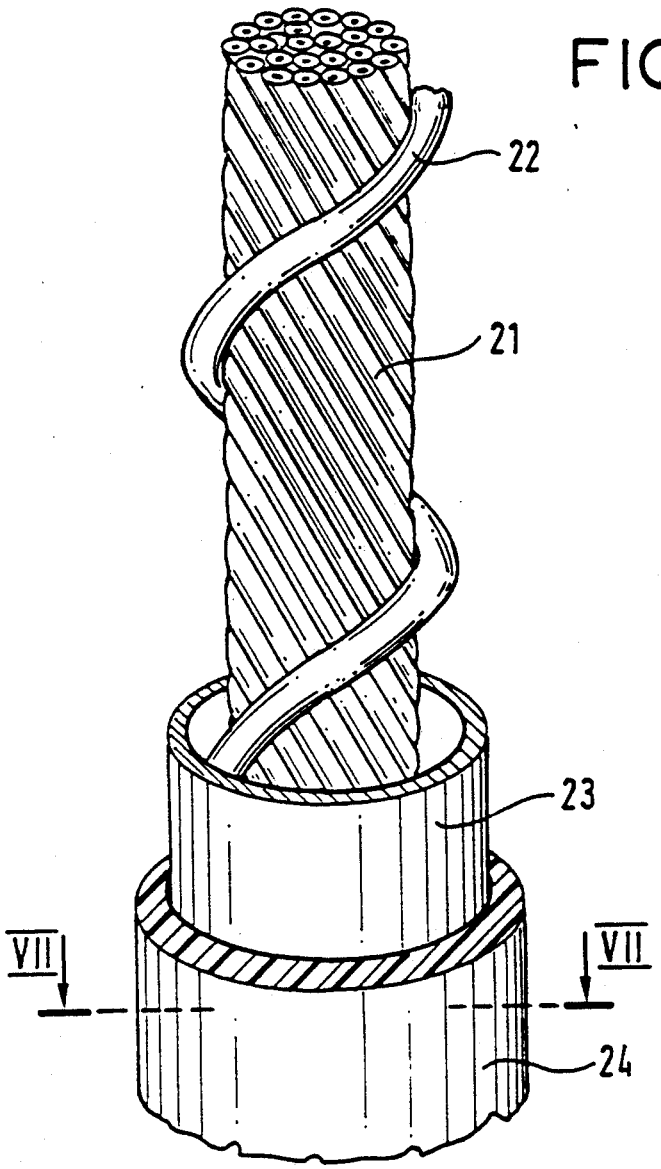
FIG. 6 shows a fourth embodiment of the cable of the invention.

FIG. 6 shows a fourth embodiment of the cable of the invention, comprising:

a plurality of twisted-together and individually insulated conductors 21;

an insulating rod 22 in the form of a helical winding and having a right cross-section that is circular;

an electrical screen 23 constituted, for example, by a helically wound metal tape; and an insulating sheath 24 covering and protecting the cable as a whole.

The rod 22 is wound in the opposite direction to the direction in which the conductors 21 are twisted. Its function is to separate the conductors 21 from the screen 23 without greatly altering the permittivity of the gap between the conductors 21 and the screen 23 compared with that which would be provided by air, and this is in contrast to conventional solutions which consist in using insulating tapes made of solid or expanded polyester, polyethylene, or polypropylene.

Each conductor 21 may be individually insulated by a continuous covering, e.g. of polyethylene, but it may also be insulated by a helical rod analogous to those described above with reference to FIG. 1 or FIG. 4. Numerous variants will occur to the person skilled in the art, e.g. using a screen that is installed lengthwise instead of a screen that is installed by helical winding.

Figure 7:
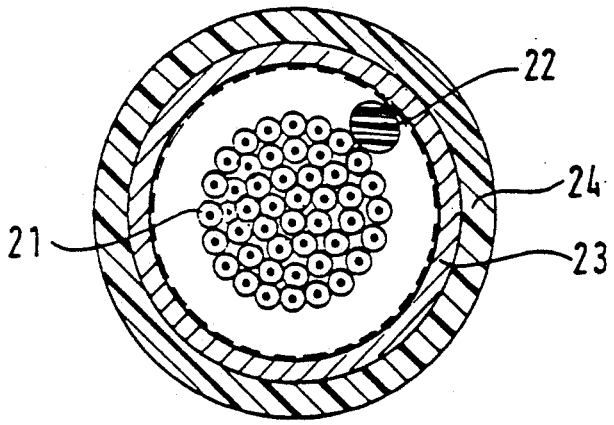
FIG. 7 is a section through the fourth embodiment.

FIG. 7 is a cross-section through the fourth embodiment on line VII–VII. It shows that the rod 22 separates the set of conductors 21 from the screen 23 by a gap whose width is substantially equal to the diameter of the right cross-section of the rod 22. As shown in the Figures, the fraction of the insulation between the conductors 21 and the screen 23 occupied by the insulating material is small, and consequently the mean permittivity of the gap remains close to that of air.

By appropriately selecting the characteristics of the rod, or of the rods, it is possible to give the cable a mean relative density of less than unity so that the cable floats.

I claim:

1. In an electric cable having high propagation velocity comprising a plurality of conductors and means for maintaining a predetermined distance between said conductors;

said means comprising at least one insulating rod helically wound with non-touching turns around at least one of the conductors, with the longitudinal axis of the helix coinciding with that of said conductor, and with each turn surrounding said conductor;

the improvement wherein said at least one rod comprises two insulating rods, and said two insulating rods surround respectively two adjacent said conductors and helically turn in opposite directions and are at different pitches that are not multiples of each other, thereby preventing said rods from interfitting.

2. A cable according to claim 1, further including an insulating sheath surrounding the insulating rods, and being of constant thickness.

3. A cable according to claim 1, wherein the conductors are individually insulated by means of respective helically wound rods.

4. An electric cable having high propagation velocity comprising a plurality of conductors and means for maintaining a predetermined distance between said conductors, said means comprising insulation individually about said conductors and said plurality of conductors being twisted together, said cable further comprising an insulating rod in the form of a helical winding and having a right cross-section that is circular and being helically wound around the plurality of twisted together insulated conductors, an external insulating sheath surrounding said plurality of twisted together individually insulated conductors and said helical wound insulating rod for covering for protecting the cable as a whole, and an electrical screen interposed between said insulating sheath and said insulating rod, and extending about said plurality of twisted together individually insulated conductors.

* * * * *